US005688198A

United States Patent [19]

Teifert et al.

[11] Patent Number: 5,688,198

[45] Date of Patent: Nov. 18, 1997

[54] DECORATIVE BASEBALL AND METHOD OF MAKING THE SAME

[75] Inventors: Dana S. Teifert, 10 Leamington Rd., Brighton, Mass. 02135; Nicholas B. Paffett, 806 Tucker La., Hingham, Mass. 02043

[73] Assignees: Dana S. Teifert, Brighton; Nicholas B. Paffett, Hingham; Edward D. Krent, Sharon, all of Mass.

[21] Appl. No.: 593,586

[22] Filed: Jan. 30, 1996

Related U.S. Application Data

[63] Continuation of Ser. No. 566,399, Dec. 1, 1995, abandoned.

[51] Int. Cl.[6] ..... A63B 69/00

[52] U.S. Cl. ..... 473/598; 473/607; 40/327

[58] Field of Search ..... 273/58 R, 58 A, 273/58 B, 58 BA, 60 R, 60 A, 65 E, 65 ED, 58 K, 58 H; 40/327; 119/711; 473/569, 596, 597, 598, 599, 600, 603, 604, 607, 608

[56] References Cited

U.S. PATENT DOCUMENTS

| | | | |
|---|---|---|---|
| 1,668,969 | 5/1928 | Maynard | 273/60 A |
| 1,861,157 | 5/1932 | Grady | 273/60 A |
| 2,324,277 | 7/1943 | Casey et al. | 273/58 K |
| 3,858,876 | 1/1975 | Williams | 273/58 R |
| 4,991,838 | 2/1991 | Groves | 273/60 R |
| 5,035,425 | 7/1991 | Edwards | 119/711 |
| 5,405,469 | 4/1995 | Lin | 273/65 E |
| 5,407,193 | 4/1995 | McGinley | 273/58 R |

OTHER PUBLICATIONS

Replogle Globes, Inc, "Planet Earth Globe," 1992.

Fotoball, "Photo Baseballs," Jan. 29, 1996.

*Primary Examiner*—Steven B. Wong
*Attorney, Agent, or Firm*—Cesari and McKenna, LLP

[57] ABSTRACT

A decorative baseball and method for making the same provides a conventional baseball having a covering over a core that includes seams and laces. The covering has a decorative pattern applied thereto that extends through the seams in substantial alignment and covers substantially an entire surface of the ball. The decorative pattern is formed by applying a pattern, initially, to a conventional ball, cutting the laces of the ball to separate the two sections of covering, reproducing the pattern from the sections and forming new sections with the pattern for application to ball cores using conventional laces.

16 Claims, 4 Drawing Sheets

DECORATIVE BASEBALL AND METHOD OF MAKING THE SAME

RELATED APPLICATION

This is a continuation-in-part of U.S. patent application Ser. No. 08/566,399, filed Dec. 1, 1995 now abandoned.

FIELD OF INVENTION

This invention relates to a decorative baseball in which substantially conventional seams and lacing are utilized and wherein a pattern passes through the seams in a substantially continuous manner.

BACKGROUND OF THE INVENTION

It is desirable to produce a decorative baseball for promotional and aesthetic purposes in which the baseball retains its well-known seams and lacing that join a covering. This covering is formed, typically, from a pair of leather or cowhide sections, each having a "dog bone" shape. The sections are overlaid on a wound center core. Prior attempts to produce patterns on baseballs that extend over the seams have involved the use of a stamping process in which the finished baseball receives an applied pattern formed from paint or ink. Prior art decoration of baseballs consists primarily of stamps of this paint or ink directly on the surface after the baseball was complete. A disadvantage of this stamping technique is that it is not possible to cover a large portion of the baseball's spherical surface.

Globes are the most commonly recognized "decorative" spheres having complex printing overlaid on substantially their entire surface. Globes are typically formed by preprinting a plurality of wedges using a carefully scaled pattern, and then applying the wedges to a spherical core. This particular technique is not readily applicable to a baseball, however, since the baseball is formed not from wedges, but from a pair of cowhide or leather sections shaped, generally, in the form of dog bones. Printing a pattern that passes over the dog bone seam is much more problematic.

It is therefore an object of this invention to provide a decorative baseball, and method for forming such a baseball, that allows a pattern to be applied accurately over seams upon substantially the entire surface of the ball. A method for forming decorative balls according to this invention should be rotally repeatable and suitable for mass-production techniques.

SUMMARY OF INVENTION

A decorative baseball and method of making the same is described herein. Unlike the prior art, this baseball includes a decorative pattern that covers substantially the entire surface of the ball. In other words, the overall ball is a decorative element. While portions of the ball may remain in a base covering color, it is contemplated that the pattern according to the invention can be disposed on any part of the ball, without regard to the existence of seams or laces. Portions of the decorative pattern will remain in substantial alignment as they pass through the seams and laces.

According to one embodiment of the invention the ball defines at least two covering sections that have a seam between them and that are joined by laces adjacent the seam. Decorative elements of the decorative pattern on each of the covering sections extend through the seam and are substantially in alignment with each other, thereby forming a continuous decorative pattern across the seam. According to this embodiment, the decorative pattern can comprise a scene of the Earth wherein at least part of the pattern defines land masses, water and clouds.

A method for making a decorative baseball includes the application of a graphic pattern to a conventional baseball having seams and laces in which at least part of the pattern crosses at least part of the seams. The laces are cut to separate at least two material covering sections from each other. The sections are laid flat and the pattern thereon is recorded for reproduction. Reproduced sections having the patterns are then formed, by cutting a sheet of material to the appropriate shape. These sections are laid back over a ball core and secured with laces so that the reproduced patterns are in substantial alignment with each other across the seams. The material covering sections can comprise dog bone-shaped sections according to one embodiment. As a further step, the reproduced dog bone-shaped sections can be provided with lace holes. Finally, it is contemplated that the graphic pattern can be applied to a conventional baseball by either adhering preprinted sections to the ball, prior to cutting the laces, or by direct application of decorative ink or paint to the baseball prior to cutting laces.

The decorative baseball according to this invention can include a scent. The scent can be applied during the construction process to the laces, interior of the covering sections or core that slowly releases from the decorative baseball over time. This scent can be selected so that it is related to the subject matter of the decorative pattern of the ball.

BRIEF DESCRIPTION OF THE DRAWINGS

The foregoing and other objects and advantages of the invention will become more clear with reference to the following detailed description as illustrated by the drawings in which.

DETAILED DESCRIPTION

Figure 1:
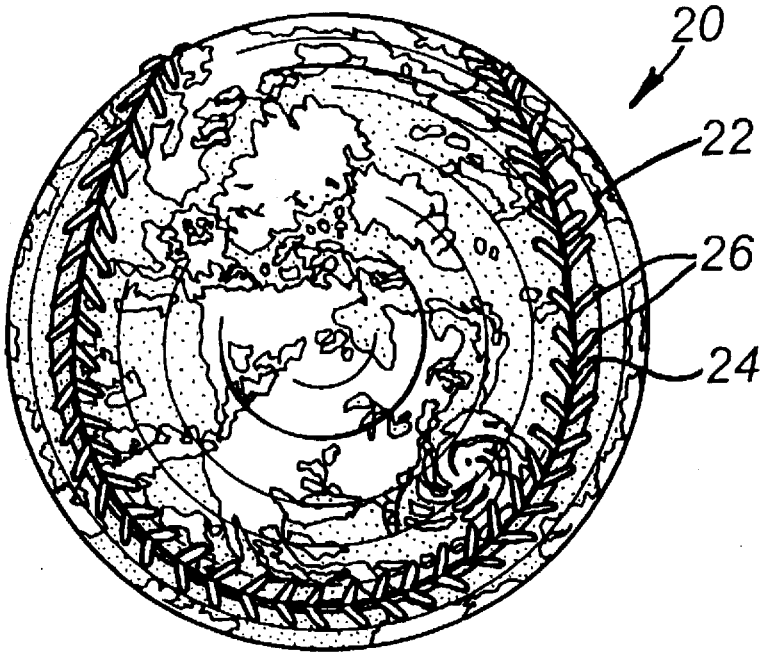
FIG. 1 is a side view of a decorative baseball depicting a view of the Earth according to this invention.

FIG. 1 illustrates a "full-bleed" decorative baseball 20 according to this invention. By "full-bleed" is meant that the decorative pattern, in this embodiment a stylized view of the Earth with images of land masses, oceans and clouds, that extend through the seam lines 22 in a substantially continuous manner. Baseball 20 is formed conventionally with an outer skin of cowhide, leather, or a comparable synthetic material with holes 24 through which laces 26 pass to secure seam lines 22 together. Laces 26 can be provided at conventional locations and in a conventional number relative to a regulation baseball. The size of the ball, likewise, can be the same as a regulation baseball, or a different-sized ball, such as a softball, can be provided. The application of the techniques described herein to different-sized and differently seamed balls (i.e., laceless) is expressly contemplated.

Figure 2:
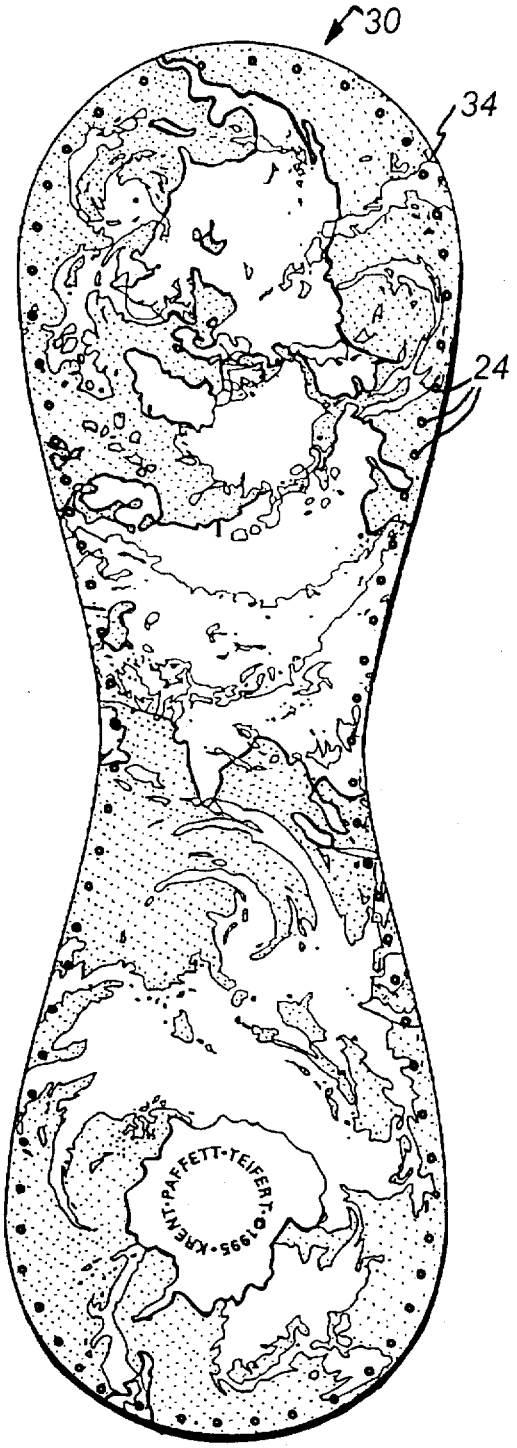
FIGS. 2 and 3 are plan views of the dog bone sections for covering the baseball of FIG. 1, including printing representative of a view of the Earth.
Figure 3:
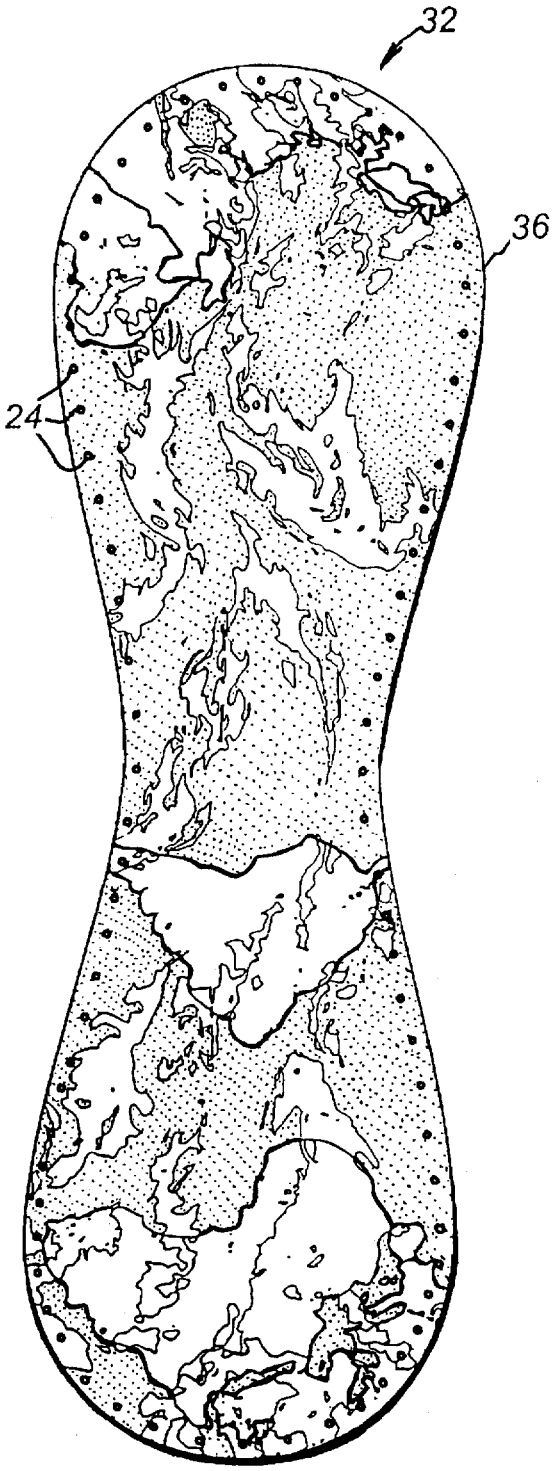

The skin of baseball 20 is formed from two dog bone sections 30 and 32 shown, respectively, in FIGS. 2 and 3. "Dog bones" 30 and 32 are shown with printing thereon that extends to the outer edges 34 and 36 respectively. Outer edges 34 and 36 also include holes 24 for receiving laces 26. From FIG. 1, it is clear that the baseball's decorative pattern will be interrupted to a small extent by the laces. This is part of the charm of the finished product and laces 26 can be provided in a different color (e.g., red) relative to the skin to accentuate their presence.

Dog bones 30 and 32 can be formed as part of a large sheet of dog bone skin material that is printed with the desired pattern using offset printing techniques, screen printing techniques, or any other desirable process for applying a pattern to a leather-like material. Conversely, each dog bone can be printed or decorated individually, subsequent to its cutting into the dog bone shape.

Figure 4:
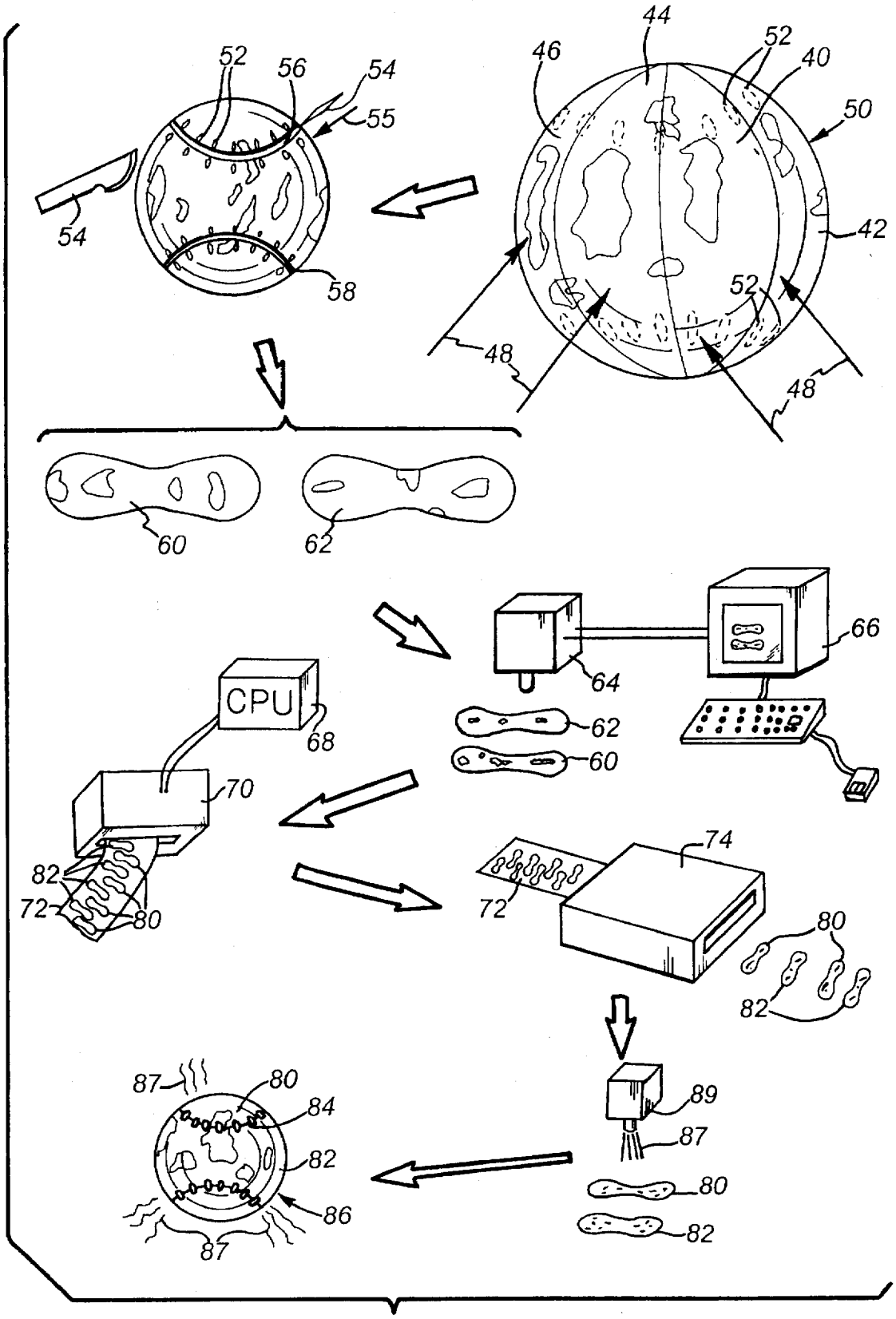
FIG. 4 is a schematic flow diagram of a method of manufacturing a decorative baseball according to this invention.

FIG. 4 illustrates a method for forming a decorative baseball according to one embodiment of this invention. Sections of artwork 40, 42, 44 and 46 are applied (arrows 48) over a conventional baseball 50. In this embodiment, artwork is generated on wedge-shaped appliques (like those of a globe), and adhered to the outer surface of baseball 50. Note that laces 52 (shown in phantom) protrude slightly through the appliques. Conversely, artwork can be applied to baseball 50 by direct painting or coloring onto the outer skin of baseball 50. The direct application of coloring onto the baseball can be accomplished by hand, or by use of appropriate computer aided design and robotic techniques. Completion of a finished design on the baseball can be a time-consuming process. The quality of the finished "master" copy is typically judged subjectively through trial and error.

Once an appropriate design is applied to baseball 50 laces 52 are cut by a blade 54 (arrow 55) to split the seam 56. Dog bones 60 and 62, with the pattern thereon are separated. These dog bones 60, 62 are laid flat. It can be necessary to adhere dog bones 60, 62 to a backboard (not shown) subsequent to removal from the ball, since they tend to be deformed into the shape of a sphere.

Figure 6:
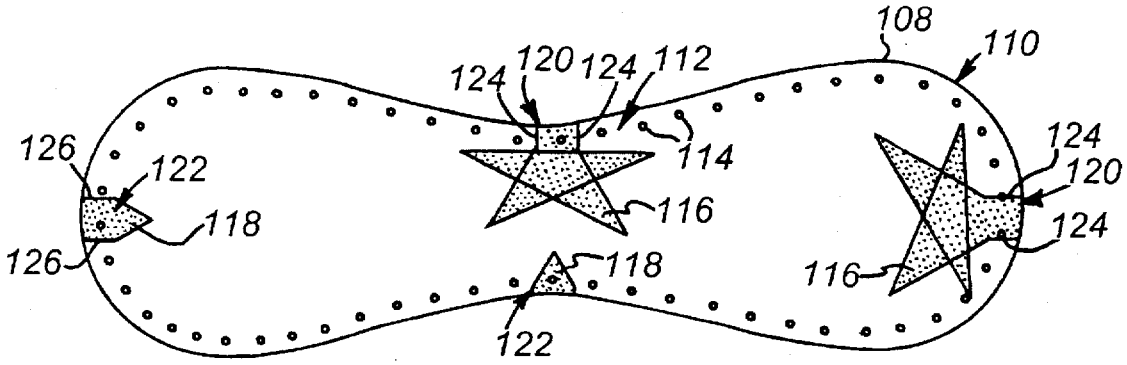
FIG. 6 is a schematic plan view of the technique for maintaining printing on the entire dog bone section according to this invention.

In this embodiment, separated dog bones 60 and 62 are viewed with a scanner 64 that is interconnected with a microcomputer 66. Using any acceptable computer aided design program such as Adobe Photoshop™ and Aldus FreeHand™, the views are recorded in the memory and enhanced as necessary to produce a desired finished pattern. Note that dog bones 60 and 62, when laid flat, will appear to have a distorted pattern, since the pattern only appears in scale when the dog bones are laid over a spherical core. This distortion remains in the computer's memory, enhancement are usually in the form of color changes and smoothing of rough lines. A further enhancement can involve the extension of boundary edges for each shape in the pattern. This extension process is described further below with reference to FIG. 6.

Next, the enhanced pattern for dog bones 60 and 62 is loaded into a CPU 68 and used to control a variable printer 70 that, in this embodiment, can comprise a printer 70. Alternatively, the data can be used to permanently form plates or screens used in continuous printing or screen printing processes, respectively. Printer 70 generates a decorative pattern in the shape of dog bones 80 and 82 on a continuous sheet 72 of natural or synthetic hide material. In this embodiment, alternating dog bone patterns 80 and 82 are formed on the same sheet 72. It is contemplated that a single pattern can be formed on a given sheet. In this embodiment, the patterns are also shown in a slightly offset relationship to save material. In other words, a lobe of one dog bone seats closely to a narrowed section of an adjacent dog bone.

The completed sheet 72 is then fed to a cutter 74 that produces individual cut dog bone sections 80 and 82. The cutter 74 can also include a conventional punch system for providing holes (not shown for reasons of clarity) to the edge of dog bones 80 and 82, or these holes can be provided in a separate step.

According to one embodiment, an appropriate scent 87 can be provided to the dog bone sections 80 and 82. The scent 87 can be applied in liquid form by a sprayer 89, or by another conventional technique for coating a surface. The scent 87 can comprise a vinyl/PVC-compatible substance for use with a synthetic or any other substance appropriate to the particular material from which the ball covering is made. For example, a leather-compatible or natural material-compatible scent can be provided when the covering of the ball is constructed from natural leather. Such scents can comprise "essential oils" according to one embodiment. The scent 87 is applied using conventional techniques. Such techniques are employed, for example, by International Flavors and Fragrances of New York.

In this embodiment, the sprayer 89 overlays a scent 87 subsequent to the cutting of dog bone sections 80 and 82. It is contemplated, generally, that the scent 87 is located along the reverse side of each dog bone section 80 and 82 so that the scent 87 does not react with the colorings on the dog bone sections, and is less prone to be worn away. The scent 87 can also be applied prior to the transfer of coloring onto the dog bone sections. For example, the scent 87 can be pre-applied to the covering material sheet 72 prior to printing. Similarly, the scent 87 can be applied to limited portions of the ball and can even be pre-applied to the laces according to another embodiment. Likewise, the scent can be applied to the core of the ball or to the wrappings that typically separate the core from the outer covering. It is contemplated that the scent 87 can be selected so that it is suggestive of the subject matter of the ball decoration. For example, a ball having the appearance of the earth, can be covered with a pine scent and/or salt water/ocean scents. Different scents can be applied to different parts of the ball.

Finally, the completed printed dog bones 80 and 82 are laced together using laces 84 over a conventional core to form a completed decorative baseball 86. The scent 87 is shown slowly diffusing into the air from the completed baseball 86.

Figure 5:
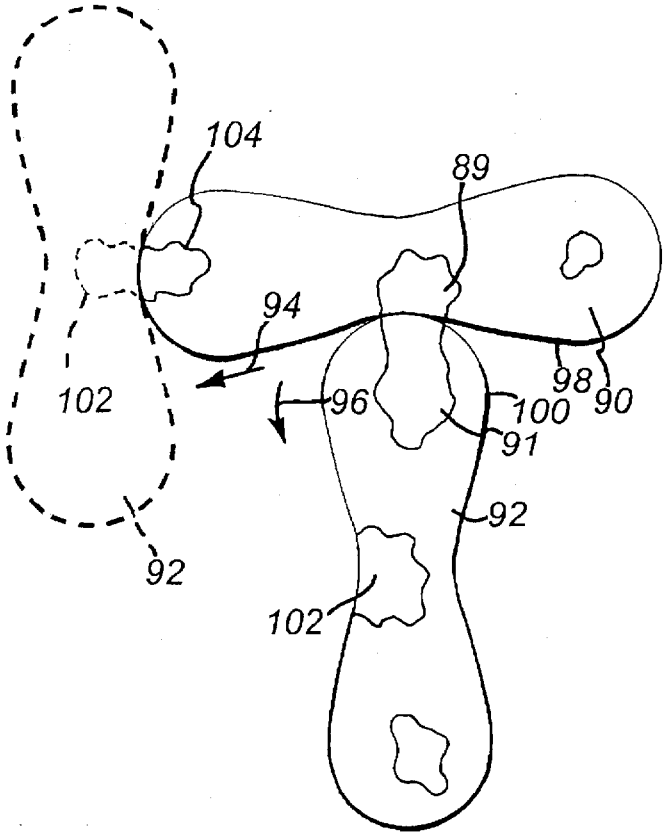
FIG. 5 is a schematic plan view of a technique for verifying alignment of portions of the design between two dog bones sections.

As depicted in FIG. 5, during the process of generating finished dog bone patterns, alignment of the patterns can be verified by aligning a pattern 89 on a first dog bone 90 with a continuing ("bled-through") pattern 91 on a second dog bone 92 and then rotating dog bones 90 and 92 (arrows 94 and 96, respectively) while maintaining the edge 98 of dog bone 90 in contact with the edge 100 of dog bone 92. Adjacent patterns 102 and 104 should also line up (as shown in phantom). As each dog bone 90 and 92 is rotated about the other, all overlapping patterns should remain in alignment. If not, then reregistration of a given pattern is required.

Finally, as noted above, FIG. 6 illustrates a technique for extending a pattern to the edge 108 of dog bone 110. Typically, the space 112 between edge 108 and holes 114 is substantially compressed in the lacing process. Thus, a portion of the pattern adjacent space 112 will disappear. In this embodiment, pattern elements 116 and 118 include a leader 120 and 122, respectively, with edge lines 124 and 126, respectively, that extend parallel to each other as continuations of the outer lines of the pattern. The leaders 120 and 122 ensure that the pattern remains continuous subsequent to compression by laces. Additionally, the leaders also ensure that the pattern will remain intact if the dog bone cutter, described above, is slightly offset relative to the printing of the dog bone pattern onto a sheet. In other words, the printed dog bone pattern is slightly larger in outer dimension than the dimension of the cutter. In this manner, slight offset is compensated. The leader on each portion of the pattern is typically one-eighth inch beyond the normally-sized pattern. Note that the space 112 between edge 108 and holes 114 is typically greater than one-eighth inch. The finished baseball according to this invention, thus, is said to have decorative patterns that are in substantial alignment with each other. By "substantial alignment" it is meant that the patterns appear to be in alignment across the seam at at least one position to the naked eye. Naturally, perfect alignment is never possible with any mechanical system. However, using the process described herein, one can reproduce a very high quality decorative baseball in a "full bleed" style that has not been available previously.

The foregoing has been detailed description of a preferred embodiment. Various modifications and additions can be made without departing from the spirit and the scope of this invention. For example, a variety of symmetrical and non-symmetrical patterns can be formed on a decorative baseball according to this invention. A variety of sizes of baseball, softball or other laced or seamed balls can be substituted. While dog bones are shown, this method can be adapted to a variety of material section shapes. Accordingly, this description is meant to be taken only by way of example and not to otherwise limit the scope of the invention.

What is claimed is:

1. A method for forming a decorative baseball comprising the steps of:

applying a graphic pattern to a conventional baseball having seams and laces at least part of the pattern crossing at least part of the seams;

cutting the laces and separating at least two material covering sections having the decorative pattern applied thereto;

storing a decorative pattern contained on each of the two sections;

reproducing the decorative patterns on further sections; and applying the further sections having reproduced patterns on the further sections to a core and securing the further sections to the core at seams with laces wherein the reproduced patterns are in substantial alignment with each other across the seams.

2. The method as set forth in claim 1 wherein the step of reproducing includes applying the decorative pattern to a plurality of locations of a continuous sheet and cutting the further sections having the decorative pattern from the sheet.

3. The method as set forth in claim 2 wherein the step of cutting includes punching holes for laces in each of the sections.

4. The method as set forth in claim 1 wherein the step of reproducing includes rotating an edge of one of the reproduced sections to another of the reproduced sections and verifying that the pattern on the one of the reproduced sections remains in alignment with the other of the reproduced sections.

5. The method as set forth in claim 1 wherein the step of applying includes adhering preprinted sections of the decorative pattern to the outer skin of a conventional baseball.

6. The method as set forth in claim 1 further comprising applying a scent that slowly diffuses from the decorative baseball.

7. The method as set forth in claim 6 wherein the step of applying the scent includes locating the scent upon an interior portion of the further sections applied to the core.

8. The method as set forth in claim 6 wherein the step of applying the scent includes applying a scent having an odor that is related to a subject matter of the decorative pattern.

9. A method for forming a decorative baseball comprising the steps of:

applying an original decorative pattern to a conventional baseball having a first pair of dog bone-shaped covering sections that are held together by laces at confronting seams, wherein the original decorative pattern extends across at least one portion of the seams;

removing each of the first pair dog bone-shaped covering sections from a first ball core and storing an image of the original decorative pattern each of the dog bone-shaped covering sections when each of the first pair of dog bone-shaped covering sections are laid substantially flat;

applying a copy of the original decorative pattern based upon the image to each of a second pair of dog bone-shaped covering sections and forming lace holes in each of the second pair of dog bone-shaped covering sections about respective perimeter edges of each of the second pair of dog bone-shaped covering sections;

wrapping each of the second pair of dog bone-shaped covering sections about a second ball core so that at least a portion of the copy of the decorative pattern on one of the second pair of dog bone-shaped covering sections is in substantial alignment with a mating portion of the decorative pattern on the other of the second pair of dog bone-shaped covering sections at a seam defined therebetween, whereby the copy of the decorative pattern extends substantially uninterrupted across an adjoining portion of the seam; and securing each of the one and the other of the second pair of dog bone-shaped covering sections together with laces.

10. The method as set forth in claim 9 wherein the step of applying the first decorative pattern includes applying a decorative pattern that comprises an image of the Earth, including at least a portion of the clouds, oceans and land masses being in substantial alignment across the seam defined between each of the pair of dog bone-shaped covering sections.

11. The method as set forth in claim 9 further comprising applying a scent to a portion of the decorative baseball, the scent being suggestive of a subject matter of the decorative pattern.

12. The method as set forth in claim 9 wherein the step of applying the copy of the original decorative pattern includes adding additional decoration to each of the second pair of dog bone-shaped covering sections that extends towards respective perimeter edges a distance further than the original decorative pattern is located on the first pair of dog bone-shaped covering sections, whereby an uninterrupted image at the seams between the one and the other of the second pair of dog bone-shaped covering sections is maintained.

13. A method for forming a decorative ball comprising the steps of:

establishing an original decorative pattern on a ball having a first set of at least two separate covering sections that are joined together at a confronting seam, wherein the original decorative pattern extends across at least one portion of the seam;

separating each of the first set of at least two covering sections from each other and storing an image of the original decorative pattern on each of the first set of at least two covering sections when each of the first set of at least two covering sections are separated;

applying a copy of the original decorative pattern based upon the image to each of a second set of at least two covering sections that are substantially identical in shape to each of the first set of at least two covering sections; and joining each of the second set of at least two covering sections together so that a portion of the copy of the decorative pattern on one of the second set of at least two covering sections is in substantial alignment with mating portions of the copy of the decorative pattern on the other of the second set of at least two covering sections at a seam defined therebetween, whereby the copy of the decorative pattern extends substantially uninterrupted across an adjoining portion of the seam; and securing each of the one and the other of the second set of at least two covering sections together with stitched laces.

14. The method as set forth in claim 13 wherein the step of storing includes, electronically scanning the first decorative pattern and recording the image of the first decorative pattern based upon the scanning step in a computer memory.

15. The method as set forth in claim 13 further comprising, applying a fragrance scent to at least one covering section of the set of at least two covering sections.

16. A decorative ball having seams and a decorative pattern that extends across the seams in substantial alignment, formed according to a process that comprises the steps of:

establishing an original decorative pattern on a ball having a first set of at least two separate covering sections that are joined together at a confronting seam, wherein the original decorative pattern extends across at least one portion of the seam;

separating each of the first set of at least two covering sections from each other and storing an image of the original decorative pattern on each of the first set of at least two covering sections when each of the first set of at least two covering sections are separated;

applying a copy of the original decorative pattern based upon the image to each of a second set of at least two covering sections that are substantially identical in shape to each of the first set of at least two covering sections;

joining each of the second set of at least two covering sections together so that a portion of the copy of the decorative pattern on one of the second set of at least two covering sections is in substantial alignment with mating portions of the copy of the decorative pattern on the other of the second set of at least two covering sections at a seam defined therebetween, whereby the copy of the decorative pattern extends substantially uninterrupted across an adjoining portion of the seam; and securing each of the one and the other of the second set of at least two covering sections together with stitched laces.

* * * * *